US011499729B2

(12) United States Patent
Yang et al.

(10) Patent No.: US 11,499,729 B2
(45) Date of Patent: Nov. 15, 2022

(54) HUMIDIFIER

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 52 days.

(21) Appl. No.: 16/859,919

(22) Filed: Apr. 27, 2020

(65) Prior Publication Data

US 2020/0340694 A1 Oct. 29, 2020

(30) Foreign Application Priority Data

Apr. 29, 2019 (CN) ..... 201910357494.1

(51) Int. Cl.
*F24F 6/14* (2006.01)
*F24F 13/24* (2006.01)
*F24F 6/00* (2006.01)

(52) U.S. Cl.
CPC ..... *F24F 6/14* (2013.01); *F24F 13/24* (2013.01); *F24F 2006/008* (2013.01)

(58) Field of Classification Search
CPC combination set(s) only.
See application file for complete search history.

(56) References Cited

U.S. PATENT DOCUMENTS 4,746,466 A * 5/1988 Takahashi ..... F24F 6/12 261/30
5,859,952 A * 1/1999 Levine ..... F24F 6/00 392/405

FOREIGN PATENT DOCUMENTS

JP H 08-110068 * 4/1996

OTHER PUBLICATIONS

EPO translation of Sei JPH 08-110068 published Apr. 30, 1996 (Year: 1996).*

* cited by examiner

*Primary Examiner* — Stephen Hobson
(74) *Attorney, Agent, or Firm* — Tsz Lung Yeung

(57) ABSTRACT

A humidifier includes a water tank for containing a predetermined amount of water, a supporting base having a water chamber, a mist discharging channel, a mist generating module for generating a mist from the water in the water chamber and generating an air flow, and a noise reduction air duct. The noise reduction air duct has an air inlet extended from the water chamber for receiving the air flow and the mist, an air outlet extended to the mist discharging channel, and a detouring channel extended between the air inlet and the air outlet for detouring a direction of the mist from the water chamber to the mist discharging channel so as to reduce a speed of the mist for noise reduction.

11 Claims, 8 Drawing Sheets

HUMIDIFIER

CROSS REFERENCE TO RELATED APPLICATION

This is a non-provisional application which claims priority to a Chinese patent application having application number of CN 201910357494.1, and filing date of Apr. 29, 2019, the entire contents of which is hereby incorporated by reference.

BACKGROUND OF THE PRESENT INVENTION

Field of Invention

The present invention relates to a household appliance, and more particularly to a humidifier.

Description of Related Arts

A room humidifier is a household appliance that increases the humidity (moisture) of a room. The humidifier is operated to add moisture to the air to prevent dryness for increased user comfort in an indoor environment, especially in a bedroom, rest area or a working area.

A traditional humidifier comprises a water tank for containing a predetermined amount of water, an atomizer for atomizing the water in the water tank to form a mist, and a fan blowing the mist through an air outlet of an air duct. Generally speaking, an air channel of the air duct defined between the fan and the air outlet the air duct is a straight air channel, wherein the fan is operated in a high speed manner to eject the mist out of the air outlet for rapidly increasing the humidity in a desired area.

A common problem of the traditional humidifier is to make unavoidable noise. The noise comes from operation of the fan and the wind sound generated by the fan. When the fan generates higher power of air flow, louder wind sound will be made. Many users find it impossible to sleep with this noise making appliance in their bedroom especially when the fan is turned on in a high power level. It is also annoying when additional sound is added to a quiet area during the operation of the humidifier. There has been a trade-off between reduced efficiency and performance of the humidifier by reducing the power of the fan on one hand and increased noise on the other.

As a result, there is a need to develop a humidifier which is quiet as well as efficient.

SUMMARY OF THE PRESENT INVENTION

Certain variations of the present invention provide a humidifier, which comprises a noise reduction air duct for detouring the air flow and reducing the air speed at the same time before discharging the mist, so as to significantly reduce the noise generated by the air flow.

Certain variations of the present invention provide a humidifier, wherein the noise reduction air duct is constructed to have a double chamber configuration to reduce the air speed and to detour the air flow via the double chamber configuration.

Certain variations of the present invention provide a humidifier, wherein the structure of the noise reduction air duct is simple to minimize the manufacturing cost of the noise reduction air duct being installed into the humidifier.

Certain variations of the present invention provide a humidifier, wherein the noise reduction air duct can be incorporated with any traditional humidifier to reduce the air speed and to detour the air flow from the traditional humidifier.

Certain variations of the present invention provide a humidifier, wherein the installation of the noise reduction air duct is easy by simply rotating the noise reduction air duct from the water tank. Therefore, the noise reduction air duct can be detached for cleaning purpose.

In one aspect of the present invention, it provides a humidifier, comprising:

a water tank for containing a predetermined amount of water;

a supporting base having a water chamber, wherein the water tank is supported on the supporting base for discharging the water from the water tank to the water chamber;

a mist discharging channel extended through the water tank to communicate with the water chamber when the water tank is supported on the supporting base;

a mist generating module for generating a mist from the water in the water chamber and generating an air flow; and a noise reduction air duct having an air inlet extended from the water chamber for receiving the air flow and the mist, an air outlet extended to the mist discharging channel, and a detouring channel extended between the air inlet and the air outlet for detouring a direction of the mist from the water chamber to the mist discharging channel so as to reduce a speed of the mist for noise reduction.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Referring to FIG. 1 to FIG. 8 of the drawings, a humidifier according to a preferred embodiment of the present invention is illustrated. Broadly, the humidifier may comprise a water tank 2 for containing a predetermined amount of water, a supporting base 1, a mist discharging channel 3, a mist generating module, and a noise reduction air duct 4.

Figure 1:
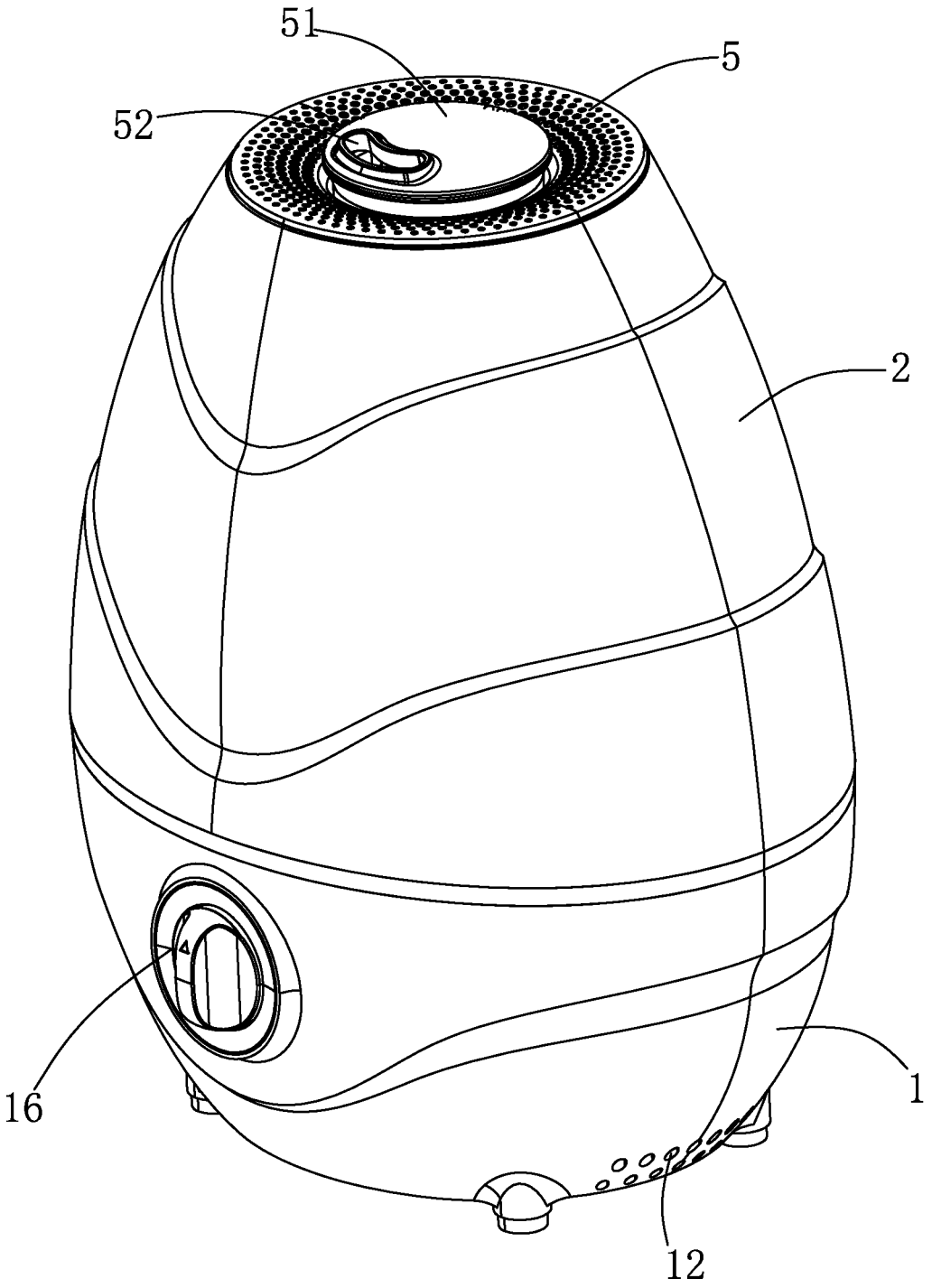
FIG. 1 is a perspective view of a humidifier according to a preferred embodiment of the present invention.

FIG. 1 illustrates a humidifier according to a preferred embodiment of the present invention, wherein the humidifier, such as a room humidifier, may comprise the supporting base 1, the water tank 2 for containing a predetermined amount of water, a mist discharging channel 3 extended through the water tank 2, and a mist dispersing cap 5 coupled on top of the water tank 2 at an outlet of the mist discharging channel 3.

Figure 2:
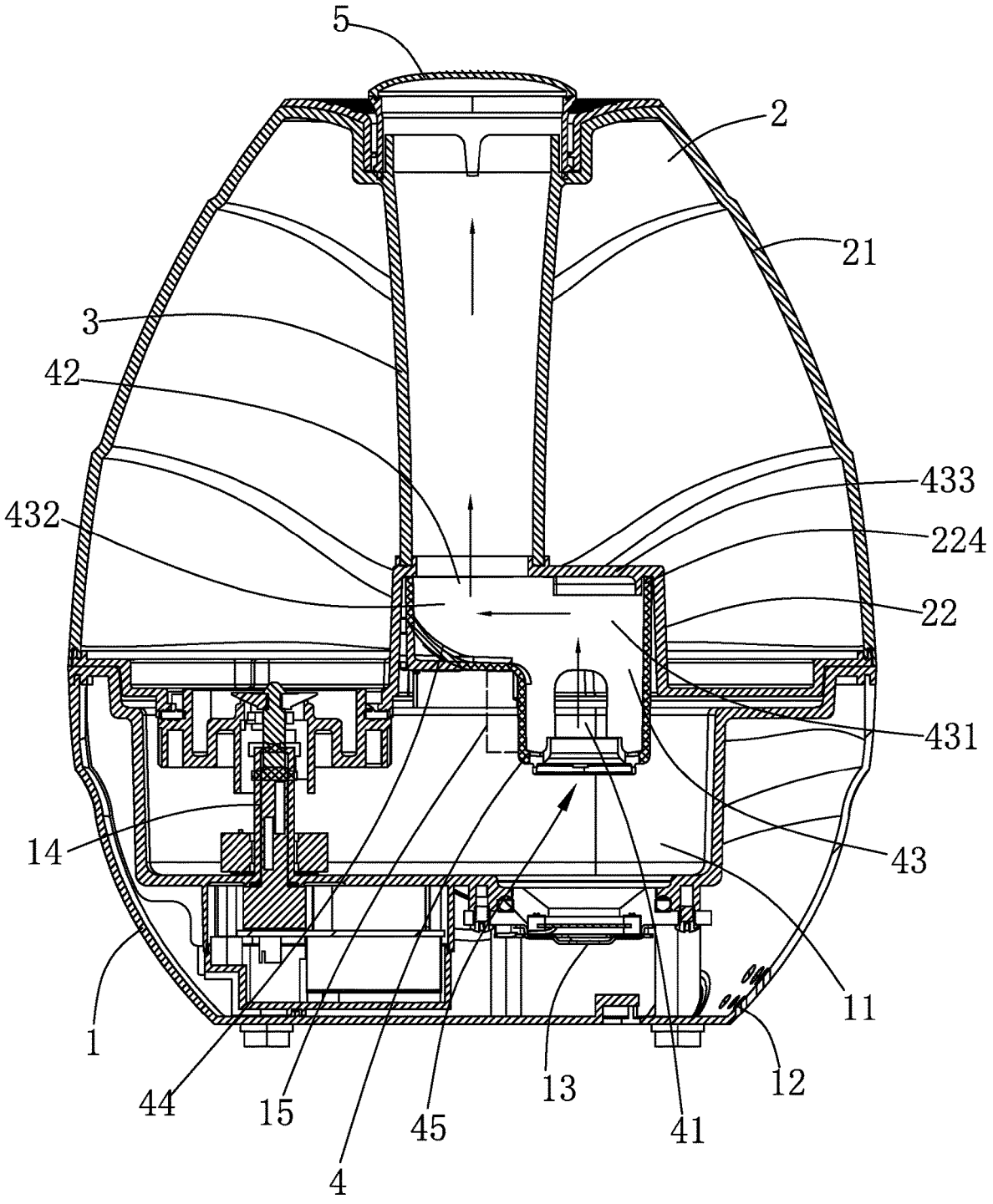
FIG. 2 is a sectional view of the humidifier according to the preferred embodiment of the present invention.

As shown in FIG. 1 and FIG. 2 of the drawings, the supporting base 1 may have a water chamber 11, wherein the water tank 2 is supported on top of the supporting base 1, such that the water in the water tank 2 will be discharged and flow to the water chamber 11 of the supporting base 1 via a water controlling valve 14. The water controlling valve 14 may be provided at the water chamber 11 to couple with the water tank 2 for controlling the water discharging from the water tank 2 to the water chamber 11 so as to prevent any overflow of the water chamber 11.

The water tank 2 may comprise a tank body 21 and a tank bottom wall 22 defining a water reservoir within the tank body 21 and the tank bottom wall 22. The tank bottom wall 22 of the water tank 2 may be coupled on the water chamber 11 of the supporting base 1. The mist discharging channel 3 may extend from the tank bottom wall 22 to a top side of the tank body 21. In this preferred embodiment, the water tank 2 may have a hollow structure to define the mist discharging channel 3 to extend through the water tank 2 in order to communicate with the water chamber 11 when the water tank 2 is supported on the supporting base 1. The mist discharging channel 3 may be a vertical straight channel extended through the water tank 2.

The humidifier may further comprise a mist generating module comprising an atomizer 13 coupled at the supporting base 1 for atomizing the water in the water chamber 11 to form a mist and a fan 15 supported in the supporting base for generating an air flow to blow the mist out of the water chamber 11 through the mist discharging channel 3. The atomizer 13 may be coupled at a bottom wall of the water chamber 11 to atomize the water therein. The supporting base 1 may further have a plurality of vent holes 12, wherein when the fan 15 is operated, the air may be sucked into the supporting base 1 through the vent holes 12 toward the water chamber 11. A control unit may be provided at the supporting base 1 to control the operation of the fan 15, such as on-and-off control and speed control.

Figure 3:
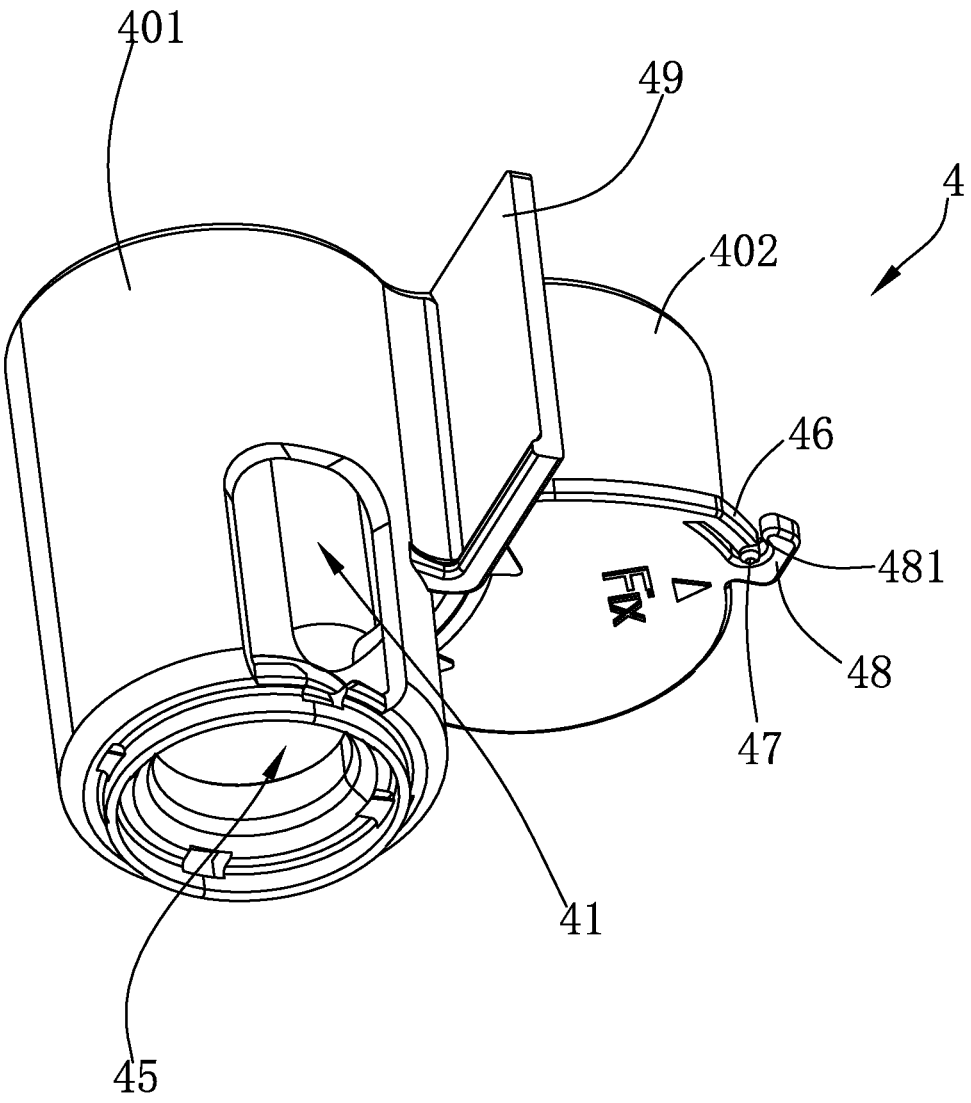
FIG. 3 is a bottom perspective view of a noise reduction air duct according to the preferred embodiment of the present invention.
Figure 4:
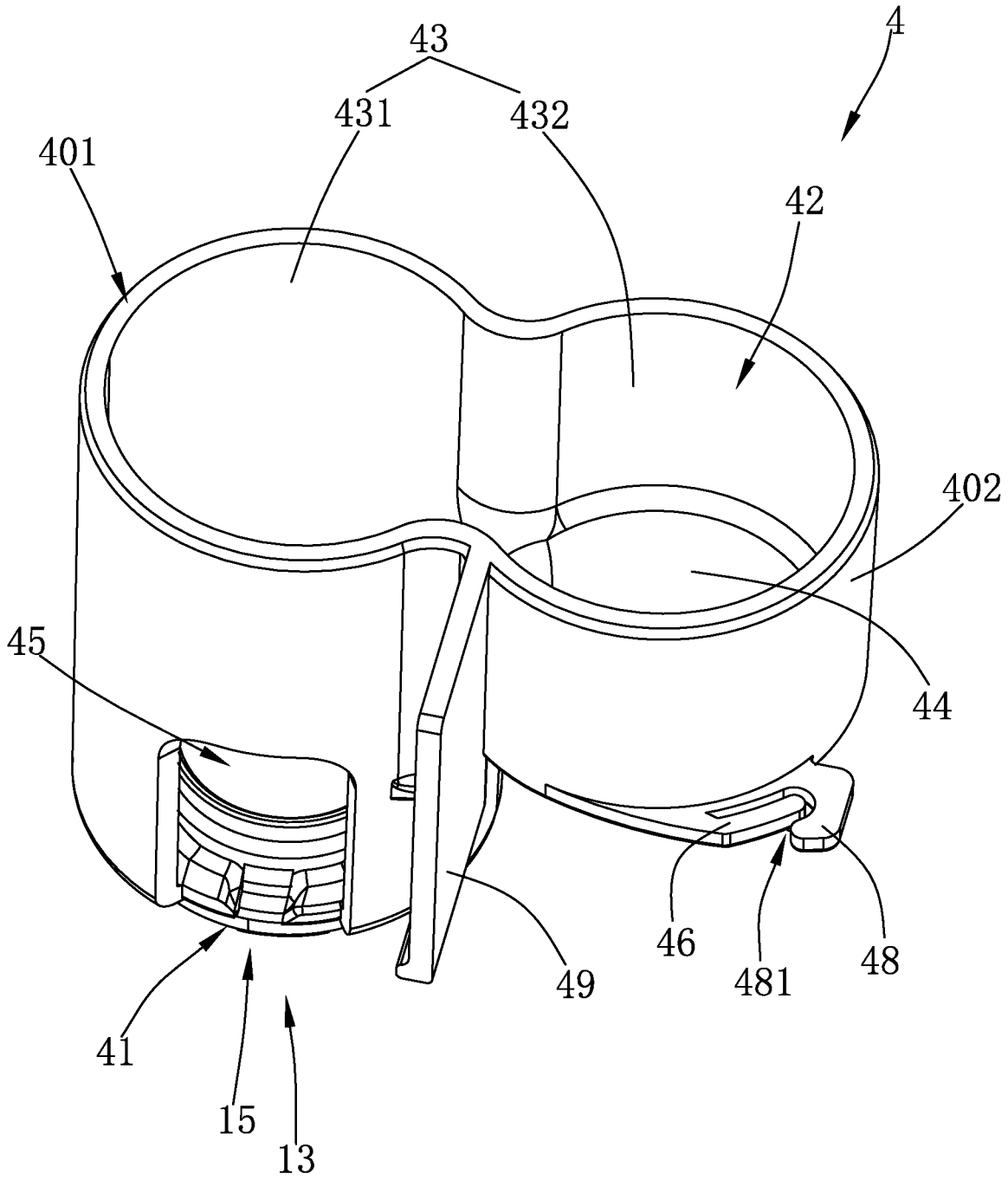
FIG. 4 is a top perspective view of a noise reduction air duct according to the preferred embodiment of the present invention.
Figure 5:
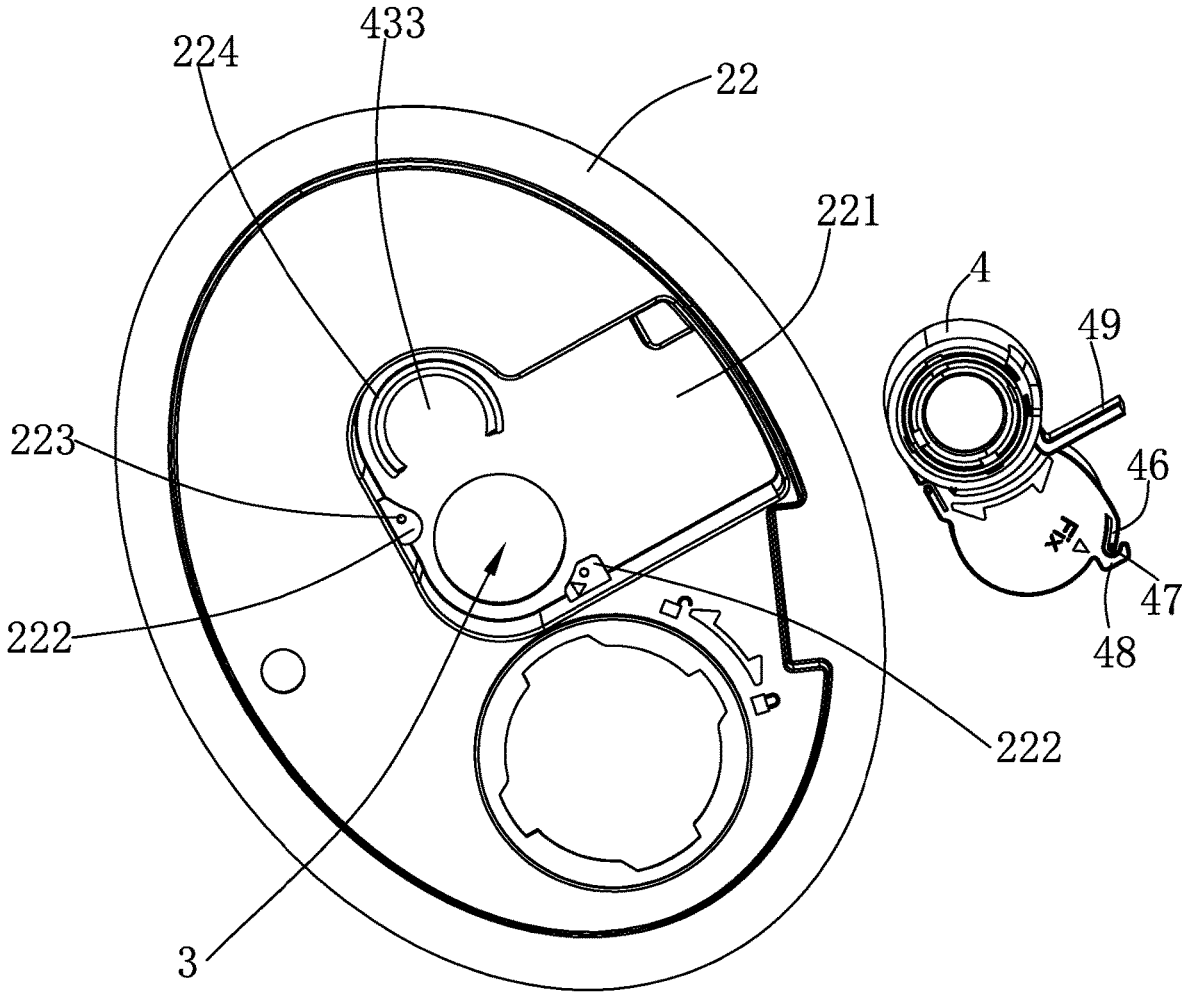
FIG. 5 is an exploded perspective view of a noise reduction air duct and a supporting base of the humidifier according to the preferred embodiment of the present invention.

As shown in FIG. 3 to FIG. 5 of the drawings, the humidifier may further comprise a noise reduction air duct 4 provided between the supporting base 1 and the water tank 2 for detouring a direction of the mist from the water chamber 11 to the mist discharging channel 3. The noise reduction air duct 4 may have a tubular structure with a circular cross section. The noise reduction air duct 4 may have an air inlet 41, an air outlet 42, and a detouring channel 43. The air inlet 41 of the noise reduction air duct 4 may extend from and be sealed at the water chamber 11 for receiving the air flow from the fan 15 and the mist generated by the atomizer 13. The air outlet 42 of the noise reduction air duct 4 may extend to and be sealed at an inlet of the mist discharging channel 3, wherein the air outlet 42 may be coaxially aligned with the mist discharging channel 3. The detouring channel 43 may extend between the air inlet 41 and the air outlet 42 for detouring the direction of the mist from the water chamber 11 to the mist discharging channel 3 so as to reduce a speed of the mist for noise reduction. In other words, the speed of the air flow at the air inlet 41 may be faster than the speed of the air flow at the air outlet 42.

As shown in FIG. 1 to FIG. 5 of the drawings, the noise reduction air duct 4 may be coupled at the tank bottom wall 22 of the water tank 11. Therefore, when the water tank 11 is mounted on the supporting base 1, the noise reduction duct 4 is supported above the water chamber 11 of the supporting base 1 at a position that the air inlet 41 of the noise reduction duct 4 is located above the water chamber 11 to align with the atomizer 13. Particularly, the tank bottom wall 22 of the water tank 2 may further have a receiving compartment 221 upwardly formed at the tank bottom wall 22, wherein the noise reduction air duct 4 may be coupled at the tank bottom wall 22 and received in the receiving compartment 221.

In this preferred embodiment, the noise reduction air duct 4 may be detachably coupled to the tank bottom wall 22 of the water tank 11, such that the noise reduction air duct 4 may be detached from the tank bottom wall 22 of the water tank 11 for cleaning after the water tank 11 is detached from the supporting base 1.

As shown in FIG. 2 of the drawings, the mist direction may be defined as: the mist may initially flow from the water chamber 11 to the noise reduction air duct 4 at the air inlet 41 and may flow from the air inlet 41 to the air outlet 42 through the detouring channel 43, then may flow from the air outlet 42 of the noise reduction air duct 4 to the mist discharging channel 3.

The detouring channel 43 of the noise reduction air duct 4 may have a buffering chamber 431 communicating with the air inlet 41 to define an air-in direction, and a guiding chamber 432 communicating with the air outlet 42 to define an air-out direction. Therefore, the mist may be guided to pass through the air inlet 41, the buffering chamber 431, the guiding chamber 432 and the air outlet 42 in sequence. Accordingly, a detouring direction between the buffering chamber 431 and the guiding chamber 432 may be transversely extended between the air-in direction and the air-out direction. The detouring direction between the buffering chamber 431 and the guiding chamber 432 may be perpendicular to the air-in direction and the air-out direction.

According to the preferred embodiment, the mist direction may be detoured twice. The mist direction may first be detoured at the buffering chamber 431 from the air inlet 41 and may be subsequently detoured at the guiding chamber 432 to the air outlet 42. As shown in FIG. 2 of the drawings, the air-in direction formed between the air inlet 41 and the buffering chamber 431 may be defined as a substantially upward direction that the mist may be guided to flow substantially upwardly and vertically from the water chamber 11 to the buffering chamber 431 through the air inlet 41.

The detouring direction formed between the buffering chamber 431 and the guiding chamber 432 may be a substantially horizontal direction that the mist is guided to flow horizontally from the buffering chamber 431 to the guiding chamber 432. The air-out direction formed between the guiding chamber 432 to the air outlet 42 may be formed as a substantially upward direction that the mist is guided to flow upwardly and vertically from the guiding chamber 432 to the mist discharging channel 3 through the air outlet 42. Therefore, the mist direction may first be detoured at 90 degrees at the buffering chamber 431 and may then be subsequently detoured at 90 degrees at the guiding chamber 432. When the air flow is detoured by the noise reduction air duct 4, the speed of the air flow will be reduced to minimize the noise generated by the air flow.

As shown in FIG. 3 to FIG. 4 of the drawings, the noise reduction air duct 4 may be constructed to have a first tubular body 401 and a second tubular body 402 integrally coupled side-by-side so that interior cavities of the first and second tubular bodies 401, 402 may communicate with each other. The buffering chamber 431 and the guiding chamber 432 may be defined at the first and second tubular bodies 401, 402 respectively. The first and second tubular bodies 401, 402 may have two top openings that the top opening at the second tubular body 402 may serve as the air outlet 42. The first tubular body 401 may have a bottom opening which may serve as the air inlet 41. The second tubular body 401 may have a closed opening.

As shown in FIG. 2 of the drawings, the noise reduction air duct 4 may further have a flat inner cornering wall 433 formed at a ceiling of the buffering chamber 431 to align with the air inlet 41, and a curved inner cornering wall 44 formed at a bottom of the guiding chamber 432 to align with the air outlet 42. The air flow may be detoured at the buffering chamber 431 by hitting at the flat inner cornering wall 433. Therefore, the air flow from the air inlet 41 may be forced to detour to the guiding chamber 432 through the buffering chamber 431 so as to reduce the speed of the air flow at the buffering chamber 431. Then, the air flow may be detoured at the guiding chamber 432 by hitting at the curved inner cornering wall 44, such that the air flow may be guided to flow along the curved inner cornering wall 44 to minimize the direct impact and flow resistance of the air flow within the guiding chamber 432 for further noise reduction. Therefore, the air flow may be guided smoothly to gradually detour to the air outlet 42 through the guiding chamber 432. It is worth mentioning that since the first tubular body 401 may have the top opening, the flat inner cornering wall 433 may be formed at a ceiling of the receiving compartment 221. It is because when the noise reduction air duct is received in the receiving compartment 221, the top opening of the first tubular body 401 is enclosed by the ceiling of the receiving compartment 221 that serves the flat inner cornering wall 433 at the ceiling of the buffering chamber 431.

According to the preferred embodiment, a depth of the buffering chamber 431 may be larger than a depth of the guiding chamber 432. The depth of the buffering chamber 431 may be defined at a distance between the air inlet 41 and the flat inner cornering wall 433. The depth of the guiding chamber 432 may be defined at a distance between the curved inner cornering wall 44 and the air outlet 42. As a result, a traveling distance of the air flow at the buffering chamber 431 may be longer than a traveling distance of the air flow at the guiding chamber 432. That is, the height of the first tubular body 401 may be longer than the height of the second tubular body 402. In other words, the depth of the buffering chamber 431 may provide enough time to reduce the speed of the air flow from the air inlet 41. Once the air flow may slow down at the buffering chamber 431, the depth of the guiding chamber 432 may be reduced to ensure the mist being rapidly discharged out of the air outlet 42.

As shown in FIGS. 3 and 4, the noise reduction air duct 4 may further have a mist inlet 45 aligned with and directly located above the atomizer 13 for guiding the mist generated by the atomizer 13 to enter into the buffering chamber 431 from the mist inlet 45. In this embodiment, the air inlet 41 may be formed at a peripheral wall of a tubular body 401 of the noise reduction air duct 4 for detouring a direction of the air flow when the air flow enters into the buffering chamber 431 through the air inlet 41.

The air inlet 41 may be formed at a peripheral wall of the tubular body 401 and communicate with the fan 15, such that the air flow generated by the fan 15 may be guided to enter into the tubular body 401 of the noise reduction air duct 4 through the air inlet 41. The mist inlet 45 may coaxially be formed with the tubular body 401 of the noise reduction air duct 4 to align with the atomizer 13, wherein a flowing direction of the mist inlet 45 may be the same as the air-in direction of said buffering chamber 431, such that the mist generated by the atomizer 13 may be guided to coaxially enter into the tubular body 401 of the noise reduction air duct 4 through the mist inlet 45. It is worth mentioning that a relatively large portion of air and a relatively small portion of mist may be mixed and entered into the air inlet 41. Likewise, a relatively small portion of air and a relatively large portion of mist are mixed and entered into the mist inlet 45. Accordingly, the air from the air inlet 41 and the mist from the mist inlet 45 may be mixed within the buffering chamber 431. A size of the air inlet 41 may be smaller than a size of the mist inlet 45. Also, since the mist inlet 45 may be aligned with the atomizer 13, the mist generated by the atomizer 13 may immediately pass from the water chamber 11 to the mist inlet 45 so as to prevent the mist being condensed and returned back to liquid form.

The noise reduction air duct 4 may further comprise an air deflector 49 extended from the first tubular body 401 at a position adjacent to the air inlet 41 for deflecting the air flow from the fan 13 toward the air inlet 41. A shown in FIG. 3 and FIG. 4 of the drawings, the air deflector 4 may integrally and inclinedly extend from the tubular body 401 to guide the maximum amount of air entering into the air inlet 41.

As shown in FIG. 5, the supporting base 2 may further comprise an engaging protrusion 222 inwardly protruded from an inner wall of the receiving compartment 221 and a positioning slot 223 formed at the engaging protrusion 222. Correspondingly, the noise reduction air duct 4 may further comprise a resilient arm 46, generally having a L-shape, outwardly extended from the second tubular body 402 and a positioning pin 47 protruded from a free end of the resilient arm 46. When the noise reduction air duct 4 is received and rotated in the receiving compartment 221, the resilient arm 46 may slide at the engaging protrusion 222 (the resilient arm 46 may be located below the engaging protrusion 222) to move the free end of the resilient arm 46 until the positioning pin 47 is engaged with the positioning slot 223 so as to couple the noise reduction air duct 4 at the tank bottom wall 22. When the noise reduction air duct 4 is rotated at the opposite direction in the receiving compartment 221, the positioning pin 47 is disengaged with the positioning slot 223 so as to detach the noise reduction air duct 4 from the tank bottom wall 22. The engaging protrusion 222 may be integrally protruded from the inner wall of the receiving compartment 221. The resilient arm 46, having an arc shape, may be integrally extended from the second tubular body 402 to space apart a peripheral surface of the second tubular body 402. It is worth mentioning two or more engaging protrusions 222 may be formed and spacedly protruded from the inner wall of the receiving compartment 221. Correspondingly two or more resilient arms 46 may be formed and extended from the second tubular body 402 to engage the positioning pins 47 with the positioning slots 223 respectively.

Accordingly, the inlet of the mist discharging channel 3 may be formed at the tank bottom wall 22 within the receiving compartment 221, wherein the engaging protrusion 222 may protrude from the inner wall of the receiving compartment 221 adjacent to the inlet of the mist discharging channel 3. Therefore, when the second tubular body 402 is received in the receiving compartment 221, the air outlet 42 is aligned with the inlet of the mist discharging channel 3 at the same time the resilient arm 46 is slid on the engaging protrusion 22 until the positioning pin 47 is engaged with the positioning slot 223.

The supporting base 2 may further comprise an arc-shaped retainer 224 integrally and downwardly protruded from the ceiling of the receiving compartment 221 to insert into the top opening of the first tubular body 401 to ensure the position of the noise reduction air duct 4 within the receiving compartment 211 and to enable the noise reduction air duct 4 being rotated in the receiving compartment 211 to engage and disengage the positioning pin 47 with the positioning slot 223. The arc-shaped retainer 224 may have a curvature matching with a curvature of an inner diameter of the first tubular member 401, i.e. the diameter of the top opening thereof. Therefore, the second tubular body 402 may be rotated about a center of the first tubular body 401 to engage and disengage the positioning pin 47 with the positioning slot 223. The arc-shaped retainer 224 may be integrally extended from the flat inner cornering wall 433.

The noise reduction air duct 4 may further comprise a protection arm 48 outwardly extended from the second tubular body 402 at the same level of the resilient arm 46. The protection arm 48 may integrally extend from the second tubular body 402 to space apart the peripheral surface of the second tubular body 402, wherein a protection groove 481 may be formed between the protection arm 48 and the peripheral surface of the second tubular body 402. The resilient arm 46 may extend into the protection groove 481, such that the resilient arm 46 may be located between the protection arm 48 and the peripheral surface of the second tubular body 402. It is worth mentioning that resilient arm 46 may extend coaxially to the second tubular body 402 at one direction and the protection arm 48 may extend coaxially to the second tubular body 402 at an opposite direction of the resilient arm 46. Since the free end of the resilient arm 46 may be elastically moved vertically in response to the rotational movement of the noise reduction air duct, the protection arm 48 may extend to protect the resilient arm 46 from being damaged by any external object. The protection arm 48 may further protect the unwanted deformation of the resilient arm 46 when the noise reduction air duct 4 is detached from the receiving compartment 221 of the water tank 2. When the resilient arm 46 is slid at the engaging protrusion 222 to engage the positioning pin 47 with the positioning slot 223, the protection arm 48 is moved to contact with a peripheral side of the engaging protrusion 222 close to a bottom side of the receiving compartment 221. Therefore, the assembly and disassembly of the noise reduction air duct 4 to the water tank 2 requires a tool-less operation, such that the user does not need any tool to attach or detach the noise reduction air duct 4 to the water tank 2. It should be appreciated that the noise reduction air duct 4 to the water tank 2 via screws.

Figure 6:
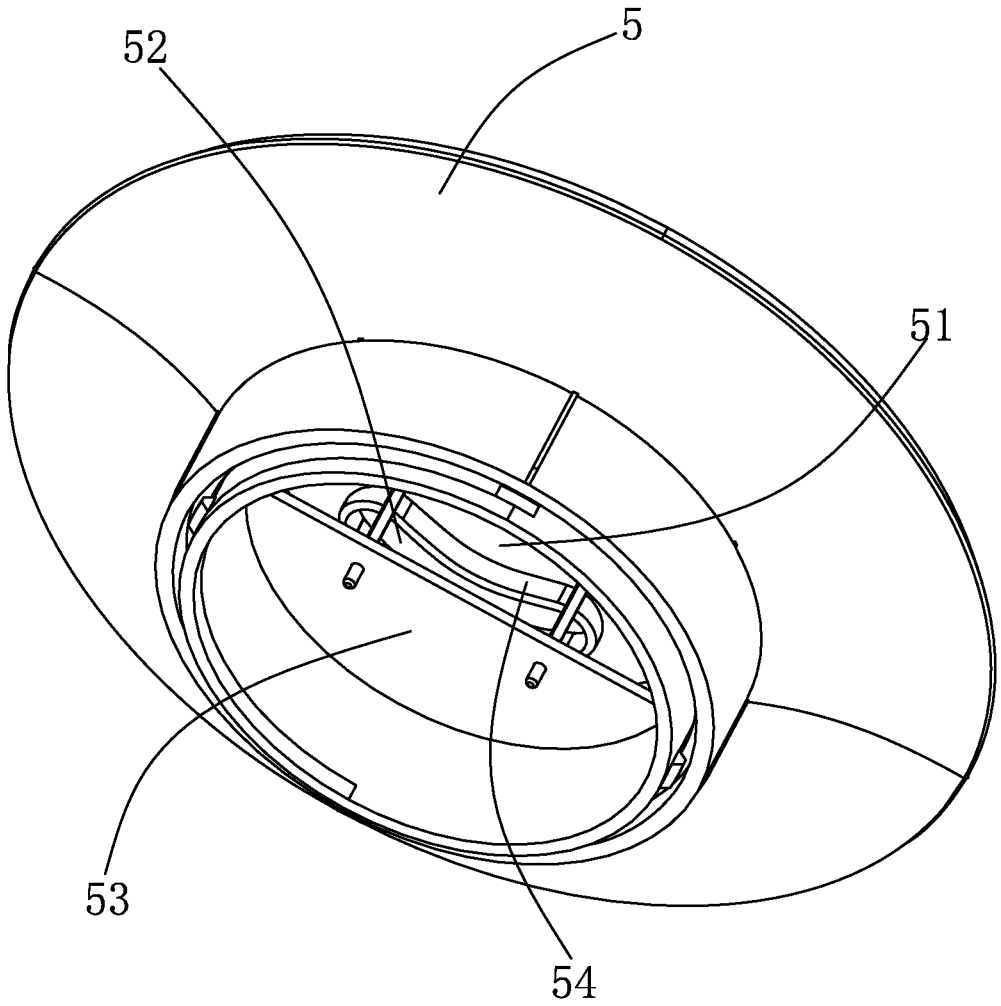
FIG. 6 is a perspective view of a mist dispersing cap according to the preferred embodiment of the present invention.
Figure 7:
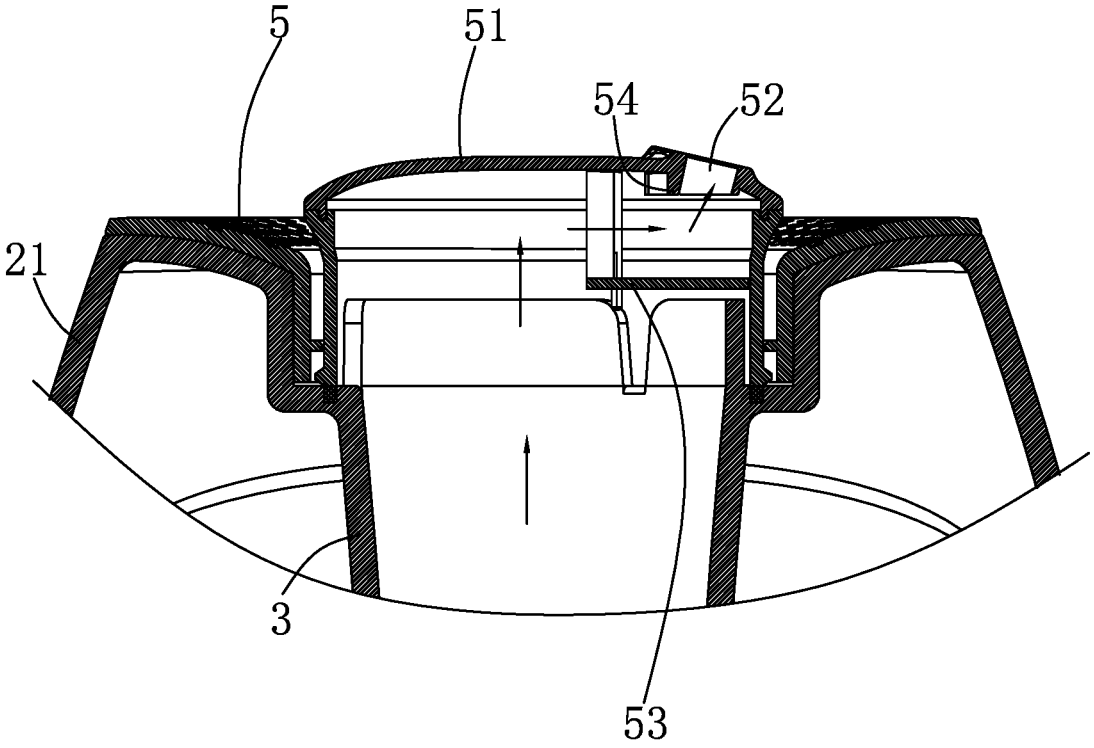
FIG. 7 is a sectional view of the mist dispersing cap mounted on water tank according to the preferred embodiment of the present invention.
Figure 8:
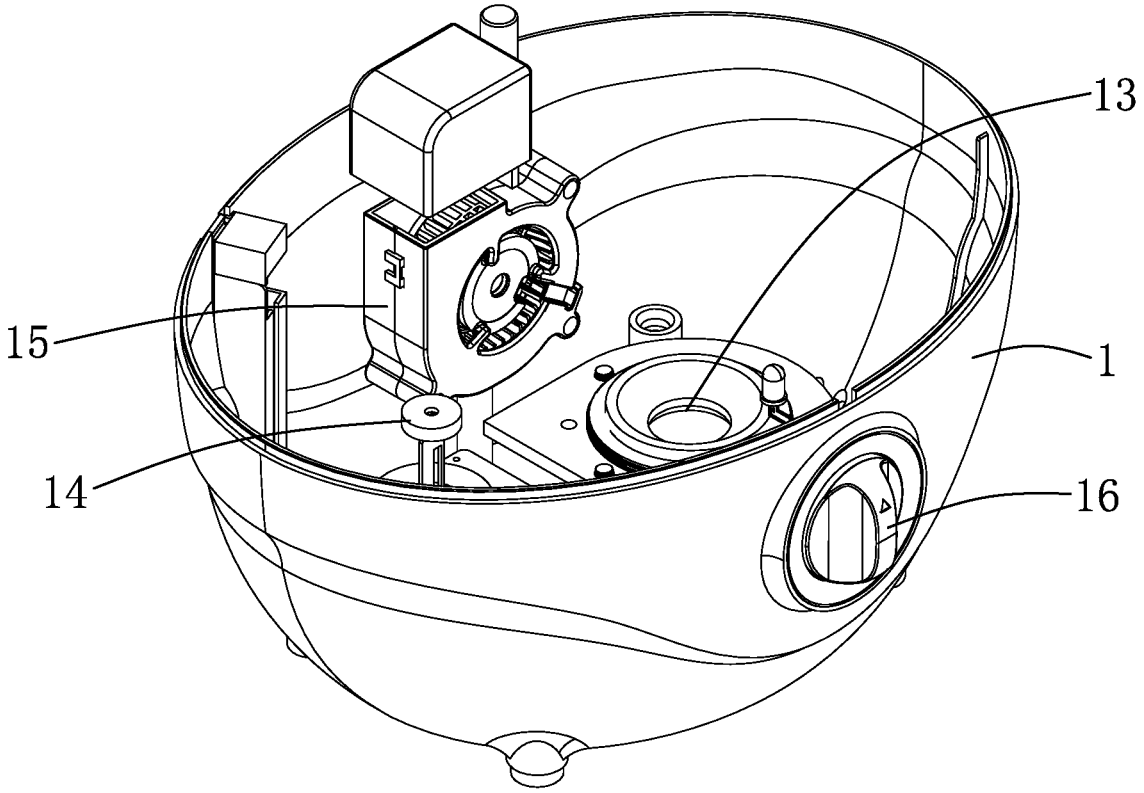
FIG. 8 is a perspective view of a supporting base of the humidifier according to the preferred embodiment of the present invention.

As shown in FIG. 1, FIG. 6 and FIG. 7 of the drawings, the mist dispersing cap 5 may detachably couple on top of the water tank 2 to cover the outlet of the mist discharging channel 3. The mist dispersing cap 5 may comprise a top panel 51 coupled on top of the water tank 2, and a mist dispersing nozzle 52, which is a through slot with a directional guider, formed on the top panel 51 to communicate with the mist discharging channel 3 for dispersing the mist from the mist discharging channel 3. The mist dispersing cap 5 may further have a decorative embossing top surface on the top panel 51 for enhancing an aesthetic appearance of the humidifier.

The mist dispersing cap 5 may further comprise a mist blocking panel 53 supported underneath the mist dispersing nozzle 52 to detour the mist direction from the mist discharging channel 3 to the mist dispersing nozzle 52, so as to further reduce the speed of the mist before exiting the mist dispersing nozzle 52 for further noise reduction. In this embodiment, the mist blocking panel 53 may be a semi-circular flat panel aligned and supported below the mist dispersing nozzle 52. It should be appreciated that the mist blocking panel 53 can be a semi-circular curved panel.

The mist dispersing cap 5 may further comprise an encircling wall 54 downwardly extended from the top panel 51 around an opening rim of the mist dispersing nozzle 52, wherein after the mist flow is detoured by the mist blocking panel 53, the encircling wall 54 will limit a dispersing area to the mist dispersing nozzle 52 to further reduce the speed of the mist flow as the final step for noise reduction.

According to the preferred embodiment, the speed test is performed at different locations of the humidifier. The air speeds at the vent holes 12 of the supporting base 1 and at the air inlet 41 of the noise reduction air duct 4 are about 2 m/s. The air speed at the buffering chamber 431 is about 1.2 m/s-1.6 m/s. The air speed at the guiding chamber 432 is about 0.6 m/s-1.2 m/s. The air speed at the mist dispersing nozzle 52 after the mist discharging channel 3 is less than 0.4 m/s. Therefore, the air speed is significantly reduced via the noise reduction air duct to minimize the noise generated by the air speed.

The noise reduction air duct 4 may provide a double-chamber structure, i.e. the buffering chamber 431 and the guiding chamber 432, as an all-in-one device to reduce the air speed. Particularly, the buffering chamber 431 may effectively reduce the air speed from the fan 13 and the guiding chamber 432 can effectively detour the air direction toward the mist discharging channel 3. The noise reduction air duct 4 may incorporate with any traditional humidifier to detour the air flow and to reduce the air speed at the same time to reduce the manufacturing cost and overall cost of the humidifier. The configuration of the noise reduction air duct 4 is simple and the installation of the noise reduction air duct 4 is easy for enhancing the production assembly and the production efficiency of the humidifier.

The present invention, while illustrated and described in terms of a preferred embodiment and several alternatives, is not limited to the particular description contained in this specification. Additional alternative or equivalent components could also be used to practice the present invention.

What is claimed is:

1. A humidifier, comprising:

a water tank for containing a predetermined amount of water;

a supporting base having a water chamber, wherein said water tank is supported on said supporting base for discharging the water from said water tank to said water chamber;

a mist discharging channel extended through said water tank to communicate with said water chamber when said water tank is supported on said supporting base;

a mist generating module which comprises an atomizer coupled at said supporting base for atomizing the water in said water chamber to form a mist and a fan supported in said supporting base for generating an air flow to blow the mist out of said water chamber through said mist discharging channel; and a noise reduction air duct having an air inlet extended from said water chamber for receiving the air flow and the mist, an air outlet extended to said mist discharging channel, and a detouring channel extended between said air inlet and said air outlet for detouring a direction of the mist from said water chamber to said mist discharging channel so as to reduce a speed of the mist for noise reduction, wherein said detouring channel of said noise reduction air duct has a buffering chamber communicating with said air inlet to define an air-in direction, and a guiding chamber communicating with said air outlet to define an air-out direction, wherein a detouring direction between said buffering chamber and said guiding chamber is transversely extended between said air-in direction and said air-out direction, said noise reduction air duct further having, a flat inner cornering wall formed at a ceiling of said buffering chamber to align with said air inlet, and a curved inner cornering wall formed at a bottom of said guiding chamber to align with said air outlet.

2. The humidifier, as recited in claim 1, wherein a depth of said buffering chamber is larger than a depth of said guiding chamber.

3. The humidifier, as recited in claim 1, wherein said noise reduction air duct further has a mist inlet aligned with and directly located above said atomizer for guiding the mist generated by said atomizer to enter into said buffering chamber from said mist inlet, wherein a flowing direction of said mist inlet is the same as said air-in direction of said buffering chamber.

4. The humidifier, as recited in claim 1, wherein said noise reduction air duct comprises a first tubular body and a second tubular body coupled side-by-side, wherein said buffering chamber and said guiding chamber are formed within said first tubular body and said second tubular body respectively, wherein said air inlet and said air outlet are defined at said first tubular body and said second tubular body respectively.

5. The humidifier, as recited in claim 4, wherein a height of said first tubular body is longer than a height of said second tubular body.

6. The humidifier, as recited in claim 4, wherein said noise reduction air duct further comprises an air deflector extended from said first tubular body at a position adjacent to said air inlet for deflecting the air flow from said fan toward said air inlet.

7. A humidifier, comprising:

a water tank for containing a predetermined amount of water;

a supporting base having a water chamber, wherein said water tank is supported on said supporting base for discharging the water from said water tank to said water chamber;

a mist discharging channel extended through said water tank to communicate with said water chamber when said water tank is supported on said supporting base;

a mist generating module which comprises an atomizer coupled at said supporting base for atomizing the water in said water chamber to form a mist and a fan supported in said supporting base for generating an air flow to blow the mist out of said water chamber through said mist discharging channel; and a noise reduction air duct having an air inlet extended from said water chamber for receiving the air flow and the mist, an air outlet extended to said mist discharging channel, and a detouring channel extended between said air inlet and said air outlet for detouring a direction of the mist from said water chamber to said mist discharging channel so as to reduce a speed of the mist for noise reduction, wherein said detouring channel of said noise reduction air duct has a buffering chamber communicating with said air inlet to define an air-in direction, and a guiding chamber communicating with said air outlet to define an air-out direction, wherein a detouring direction between said buffering chamber and said guiding chamber is transversely extended between said air-in direction and said air-out direction, said noise reduction air duct comprising a first tubular body and a second tubular body coupled side-by-side, wherein said buffering chamber and said guiding chamber are formed within said first tubular body and said second tubular body respectively, wherein said air inlet and said air outlet are defined at said first tubular body and said second tubular body respectively, wherein said air inlet is formed at a peripheral wall of said first tubular body of said noise reduction air duct for detouring a direction of the air flow when the air flow enters into said buffering chamber through said air inlet.

8. The humidifier, as recited in claim 7, wherein said noise reduction air duct further has a mist inlet aligned with and directly located above said atomizer for guiding the mist generated by said atomizer to enter into said buffering chamber from said mist inlet, wherein said mist inlet is coaxially formed at said first tubular body.

9. A humidifier, comprising:

a water tank for containing a predetermined amount of water;

a supporting base having a water chamber, wherein said water tank is supported on said supporting base for discharging the water from said water tank to said water chamber;

a mist discharging channel extended through said water tank to communicate with said water chamber when said water tank is supported on said supporting base;

a mist generating module which comprises an atomizer coupled at said supporting base for atomizing the water in said water chamber to form a mist and a fan supported in said supporting base for generating an air flow to blow the mist out of said water chamber through said mist discharging channel; and a noise reduction air duct having an air inlet extended from said water chamber for receiving the air flow and the mist, an air outlet extended to said mist discharging channel, and a detouring channel extended between said air inlet and said air outlet for detouring a direction of the mist from said water chamber to said mist discharging channel so as to reduce a speed of the mist for noise reduction, wherein said water tank comprises a tank bottom wall and a receiving compartment upwardly formed at said tank bottom wall, wherein said noise reduction air duct is detachably coupled at said tank bottom wall and received in said receiving compartment.

10. The humidifier, as recited in claim 9, wherein said supporting base further comprises an engaging protrusion inwardly protruded from an inner wall of said receiving compartment and a positioning slot formed at said engaging protrusion, wherein said noise reduction air duct further comprises a resilient arm extended outwardly and a positioning pin protruded from a free end of said resilient arm, wherein when said noise reduction air duct is received and rotated in said receiving compartment, said resilient arm is slid at said engaging protrusion to move said free end of said resilient arm until said positioning pin is engaged with said positioning slot so as to couple said noise reduction air duct at said tank bottom wall.

11. The humidifier, as recited in claim 10, wherein said noise reduction air duct further comprises a protection arm extended outwardly at a position that said resilient arm is located between said noise reduction air duct and said protection arm.

* * * * *